US007992965B2

(12) United States Patent
Komplin et al.

(10) Patent No.: US 7,992,965 B2
(45) Date of Patent: Aug. 9, 2011

(54) INK JET PRINTHEAD CONFIGURED TO MINIMIZE INK-FLOW DEAD ZONES IN THE BUBBLE CHAMBER

(75) Inventors: Steven Robert Komplin, Lexington, KY (US); James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 517 days.

(21) Appl. No.: 12/165,672

(22) Filed: Jul. 1, 2008

(65) Prior Publication Data

US 2010/0002052 A1 Jan. 7, 2010

(51) Int. Cl.
*B41J 2/14* (2006.01)

(52) U.S. Cl. ..... 347/47; 347/62

(58) Field of Classification Search ..... 347/40, 347/43, 70, 71, 65, 47, 61, 62
See application file for complete search history.

(56) References Cited

U.S. PATENT DOCUMENTS 6,923,528 B2 * 8/2005 Shimada ..... 347/68
* cited by examiner

*Primary Examiner* — Lamson D Nguyen

(57) ABSTRACT

An ink jet printhead for use in ink jet printing includes a substrate and a nozzle plate. The substrate has an oblong recessed region forming a ceiling and interior side walls of a bubble chamber. The oblong recessed region has a length dimension that is greater than its width dimension. The oblong recessed region has a first end spaced apart from a second end in the length dimension. The substrate has an ink inlet channel passing through the ceiling to form an ink inlet port near the first end of the oblong recessed region. The nozzle plate is attached to the substrate to form a floor of the bubble chamber. The nozzle plate has an ink jet nozzle passing through the nozzle plate. The ink jet nozzle is positioned in fluid communication with the bubble chamber at a location near the second end of the recessed region.

15 Claims, 5 Drawing Sheets

INK JET PRINTHEAD CONFIGURED TO MINIMIZE INK-FLOW DEAD ZONES IN THE BUBBLE CHAMBER

CROSS-REFERENCE TO RELATED APPLICATIONS

None.

MICROFICHE APPENDIX

None.

GOVERNMENT RIGHTS IN PATENT

None

BACKGROUND OF THE INVENTION

1. Field of the Invention

The present invention relates to an ink jet printhead, and, more particularly, to an ink jet printhead having a bubble chamber, and configured to minimize ink-flow dead zones in the bubble chamber.

2. Description of the Related Art

An imaging apparatus, such as an ink jet printer, forms an image on a print medium, such as paper, by applying ink to the print medium. Such an ink jet printer includes a reciprocating printhead carrier that transports one or more ink jet printheads across the print medium along a bi-directional scanning path defining a print zone of the printer. One such ink jet printer mounts a plurality of ink supply tanks, with each ink tank containing a supply of a particular color of ink, e.g., black, cyan, magenta, and yellow, and with each ink tank being in fluid communication with a respective ink jet printhead.

In one example, an ink jet printhead may be permanently attached to an ink supply tank to form an ink jet printhead cartridge, which is installed on the printhead carrier as an integral unit. In another example, an ink jet printhead assembly having an ink jet printhead is removably mounted to the printhead carrier, and an ink supply tank is removably mounted to the ink jet printhead assembly.

An ink jet printhead includes a substrate to which a nozzle plate is attached. Formed in the substrate is a bubble chamber. An actuator element is positioned, or formed, in the bubble chamber. The actuator element may be, for example, a resistive heater element or a piezoelectric element. An ink jet printhead that uses resistive heater elements also may be referred to as a thermal ink jet printhead. Heat generated by a heater element causes a vapor bubble to form in the bubble chamber, thus ejecting an ink droplet from a corresponding ink jet nozzle.

Referring to FIGS. 1A and 1B, there is shown a portion of a prior art ink jet printhead 10 configured with a bubble chamber 12 having two side ink inlets 14-1, 14-2 positioned along a lengthwise wall 12-1 of bubble chamber 12, and having a nozzle plate 16 having an ink jet nozzle 18 positioned over the center of bubble chamber 12. A resistive heater element 20 is suspended in bubble chamber 12. In this configuration, however, ink-flow dead zones tend to form in bubble chamber 12 due to the proximity of the ink inlets 14-1, 14-2 and ink jet nozzle 18. Deleteriously, air bubbles tend to accumulate in ink-flow dead-zones in bubble chamber 12 and their presence degrades the efficiency and regularity of energy transfer from the vapor bubble to the ink. The presence of air bubbles can reduce the velocity of an ink droplet ejected through the corresponding ink jet nozzle 18 of nozzle plate 16 and increase the variation among droplet ejections.

What is needed in the art is an ink jet printhead that is configured to minimize, i.e., reduce or eliminate, ink-flow dead zones in the bubble chamber.

SUMMARY OF THE INVENTION

The present invention provides an ink jet printhead that is configured to minimize, i.e., reduce or eliminate, ink-flow dead zones in the bubble chamber of the ink jet printhead.

The terms "first" and "second" preceding an element name, e.g., first end, second end, etc., are used for identification purposes to distinguish between similar elements, and are not intended to necessarily imply order, nor are the terms "first" and "second" intended to preclude the inclusion of additional similar elements. Also, the terms "ceiling" and "floor" are used to describe surfaces of the ink jet printhead in the orientation shown in the drawings, but do not preclude the re-orienting of the ink jet printhead to other orientations in actual use.

The invention, in one form thereof, is directed to an ink jet printhead for use in ink jet printing that includes a substrate and a nozzle plate. The substrate has an oblong recessed region forming a ceiling and interior side walls of a bubble chamber. The oblong recessed region has a length dimension and a width dimension. The length dimension is greater than the width dimension. The oblong recessed region has a first end spaced apart from a second end in the length dimension. The substrate has an ink inlet channel passing through the ceiling to form an ink inlet port near the first end of the oblong recessed region. The nozzle plate is attached to the substrate to form a floor of the bubble chamber. The nozzle plate has an ink jet nozzle passing through the nozzle plate. The ink jet nozzle is positioned in fluid communication with the bubble chamber at a location near the second end of the recessed region.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1A:
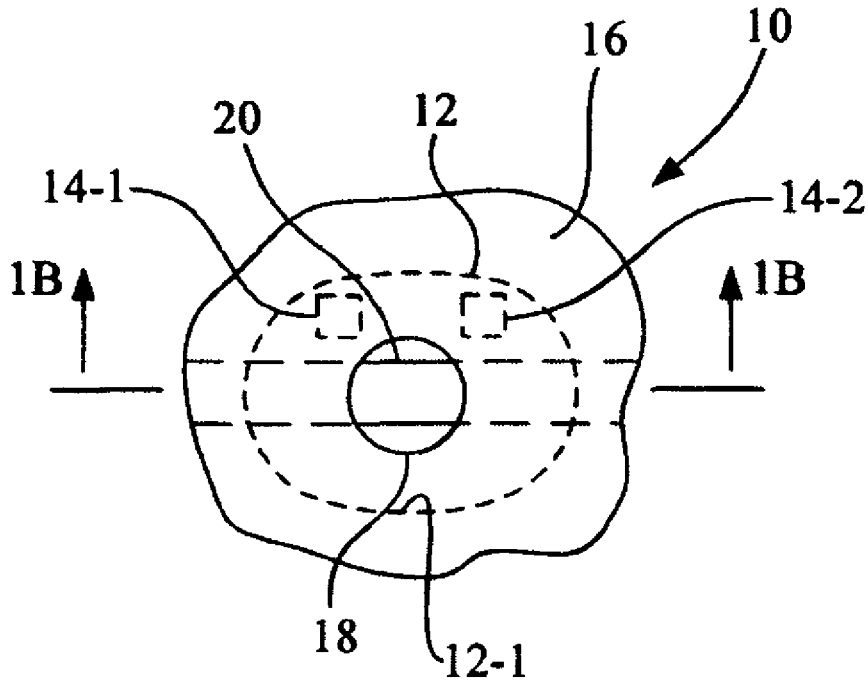
Fig. 1A (PRIOR ART)
FIG. 1A is a bottom view of a portion of a prior art ink jet printhead showing relative locations of the ink inlets and the ink jet nozzle in relation to the bubble chamber.
Figure 1B:
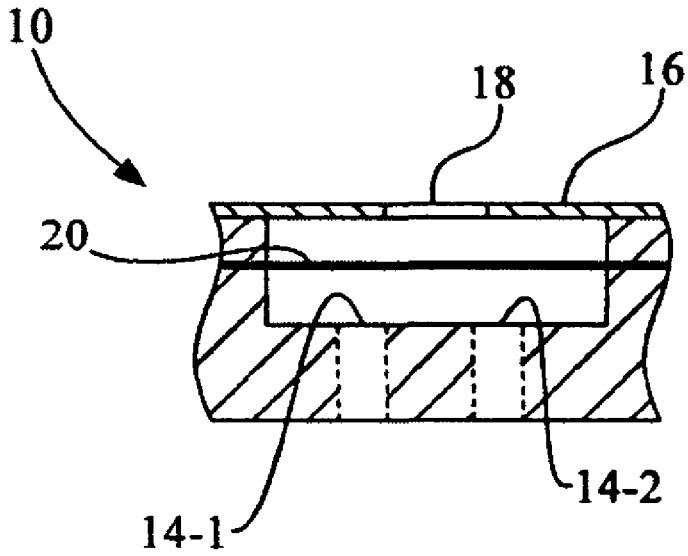
Fig. 1B (PRIOR ART)
FIG. 1B is a side section view of the ink jet printhead of FIG. 1A taken along line IB-IB.
Figure 2:
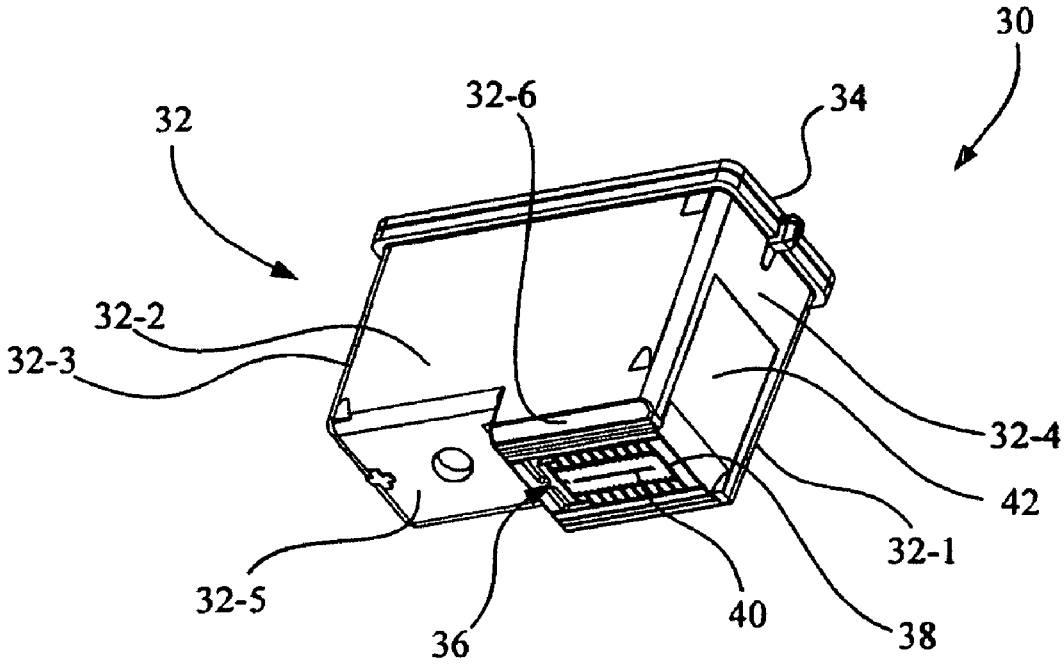
FIG. 2 is a bottom perspective view of a printhead cartridge having an ink jet printhead configured in accordance with an embodiment of the present invention.

Referring now to the drawings and particularly to FIG. 2, there is shown an embodiment of the present invention in the form of an ink jet printhead cartridge 30.

Ink jet printhead cartridge 30 includes a reservoir body 32, a top cover 34 and an ink jet printhead 36. Reservoir body 32 may be molded as a single-piece unitary structure that includes a first side 32-1, a second side 32-2, a front side 32-3, a back side 324, and a bottom side 32-5 including a snout portion 32-6. Ink is contained in reservoir body 32, and top cover 34 completes the enclosure to contain the ink.

In the present embodiment, ink jet printhead 36 is attached to snout portion 32-6 of ink jet printhead cartridge 30. Ink jet printhead 36 includes a nozzle plate 38 having formed therein a plurality of ink jet nozzles 40. Fluid passageways (not shown) provide one or more paths for ink to flow from reservoir body 32 to ink jet printhead 36. Electrical connections may be, for example, made to ink jet printhead 36 from a printer (not shown) via a tape automated bond (TAB) circuit 42 located on back side 324 of ink jet printhead cartridge 30, which in turn is in electrical communication with ink jet printhead 36.

Figure 3A:
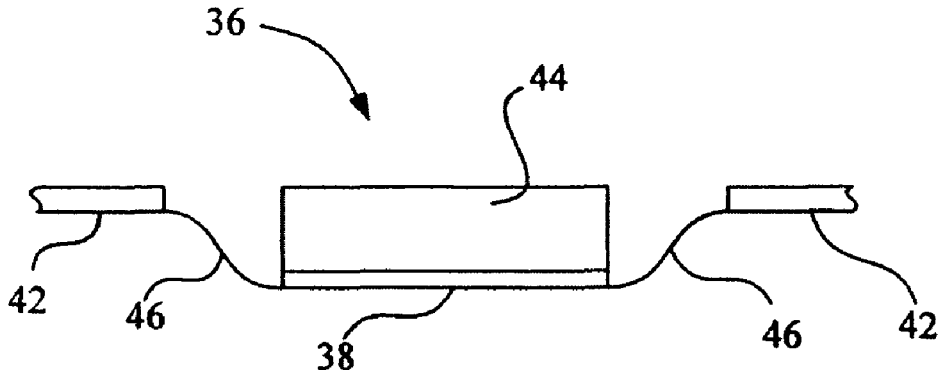
FIG. 3A is a diagrammatic end view of the ink jet printhead configured in accordance with an embodiment of the present invention.
Figure 3B:
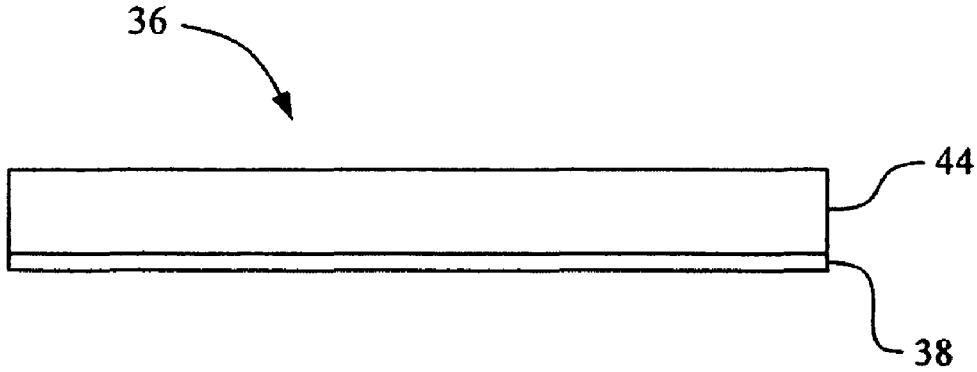
FIG. 3B is a diagrammatic side view of the ink jet printhead of FIG. 3A.
Figure 3C:
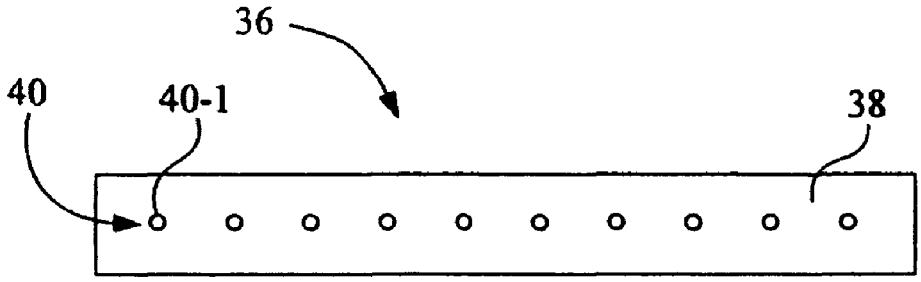
FIG. 3C is a diagrammatic bottom view of the ink jet printhead of FIG. 3A showing a nozzle plate having a plurality of ink jet nozzles.

Referring to FIGS. 3A-3C, there is shown a diagrammatic illustration of ink jet printhead 36. Ink jet printhead 36 includes a substrate 44, e.g., a silicon substrate, to which nozzle plate 38 is permanently attached, e.g., by adhesive. In the present embodiment, a plurality of electrical connectors 46 electrically connects ink jet printhead 36 to TAB circuit 42. For ease of illustration, the plurality of ink jet nozzles 40 of nozzle plate 38 is shown to include 10 nozzles, but those skilled in the art will recognize that the actual number of ink jet nozzles in nozzle plate 38 may number in the hundreds or thousands of ink jet nozzles.

Figure 4A:
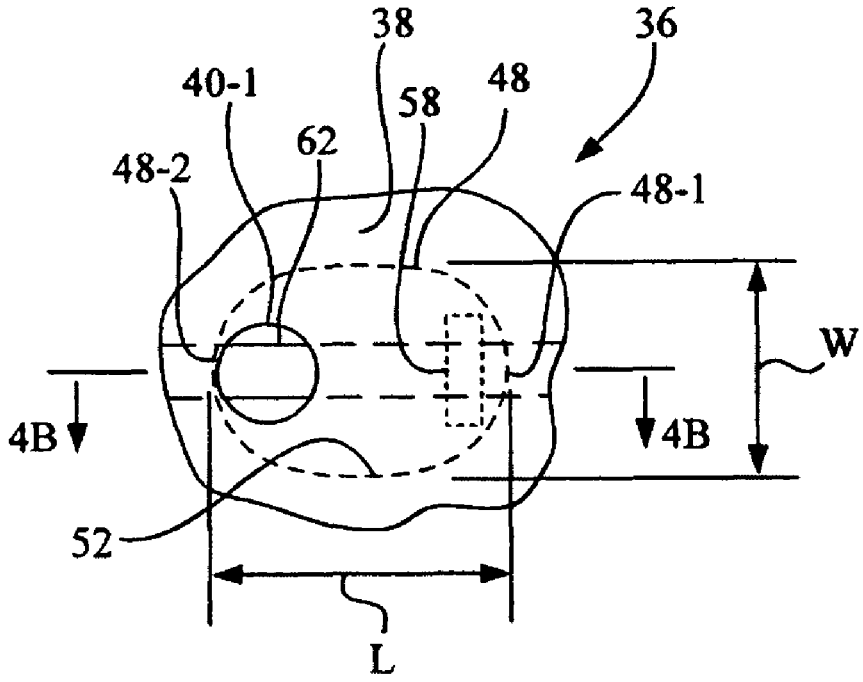
FIG. 4A is a bottom view of a portion of ink jet printhead of FIGS. 3A-3C showing relative locations of the ink inlet port and the ink jet nozzle in relation to the bubble chamber in accordance with an embodiment of the present invention.
Figure 4B:
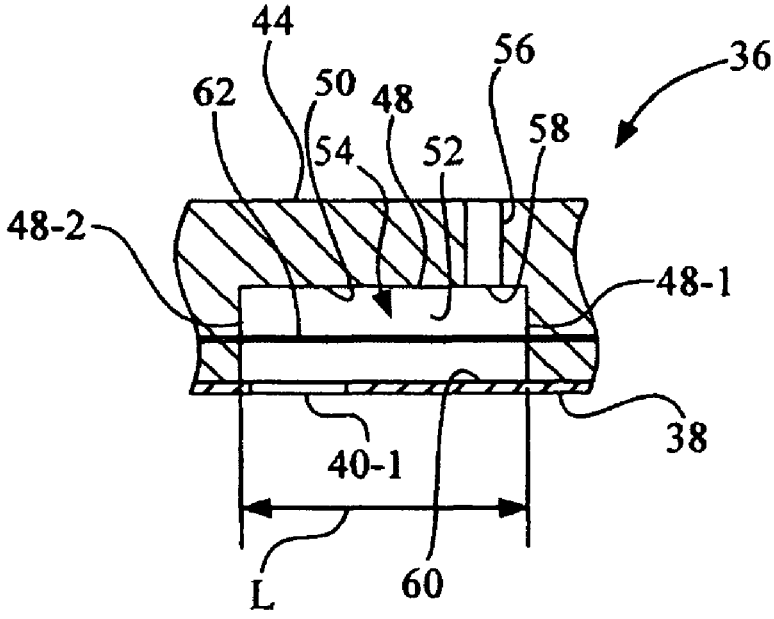
FIG. 4B is a side section view of the ink jet printhead of FIG. 4A taken along line 4B-4B.

Referring to FIGS. 4A and 4B, substrate 44 has an oblong recessed region 48 forming a ceiling 50 and interior side walls 52 of a bubble chamber 54. Oblong recessed region 48 has a length dimension L and a width dimension W. Length dimension L is greater than width dimension W. Oblong recessed region 48 has a first end 48-1 spaced apart from a second end 48-2 in length dimension L.

Substrate 44 has an ink inlet channel 56 passing through ceiling 50 to form an ink inlet port 58 near first end 48-1 of oblong recessed region 48. In this context, the term "near" means positioned within a distance range of 15 percent or less of the total length dimension L of oblong recessed region 48, and more preferably, 5 percent or less. For example, and not by way of limitation, if the length dimension L of oblong recessed region 48 is 100 microns, then ink inlet port 58 is positioned no more than 15 microns (i.e., in a range of zero through 15 microns) away from first end 48-1 of oblong recessed region 48.

Figure 5:
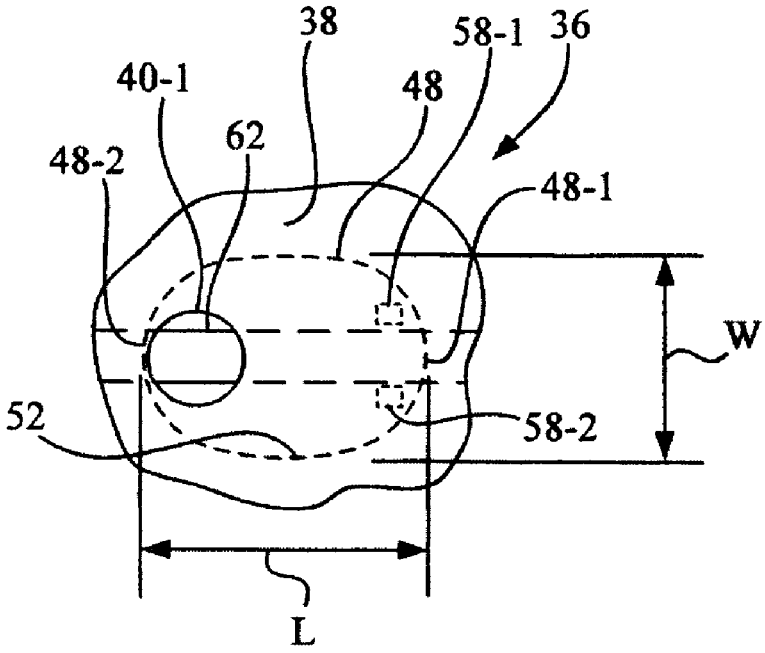
FIG. 5 is an alternate embodiment of the ink jet printhead of FIG. 4A, with the ink inlet port being formed by two separate openings.

Nozzle plate 38 is attached to substrate 44 to form a floor 60 of bubble chamber 54. In the present example, nozzle plate 38 has an ink jet nozzle 40-1 that passes through nozzle plate 38. Ink jet nozzle 40-1 may be round, as shown in FIGS. 4A and 5, or alternatively, may be another rounded shape, such as oval or elliptical. Ink jet nozzle 40-1 is positioned in fluid communication with bubble chamber 54 at a location near second end 48-2 of oblong recessed region 48. In this context, the term "near" means positioned within a distance range of 15 percent or less of the total length dimension L of oblong recessed region 48, and more preferably, 5 percent or less. For example, and not by way of limitation, if the length dimension L of oblong recessed region 48 is 100 microns, then ink jet nozzle 40-1 is positioned no more than 15 microns (i.e., in a range of zero through 15 microns) away from second end 48-2 of oblong recessed region 48.

A resistive heater element 62 is suspended from first end 48-1 to second end 48-2 of oblong recessed region 48 of bubble chamber 54, and is suspended between floor 60 and ceiling 50 of bubble chamber 54. Suspended heater elements are known in the art as evidenced by the teachings of U.S. Patent Application No. 20070146429, entitled Printhead Integrated Circuit Having Suspended Heater Elements," the contents of which is hereby incorporated by reference.

As best illustrated in FIG. 4A, each of first end 48-1 of oblong recessed region 48 and second end 48-2 of oblong recessed region 48 are formed as a smooth curve. In one preferred embodiment, oblong recessed region 48 may be oval in shape. However, those skilled in the art will recognize that other oblong shapes, e.g., elliptical or polygonal, may be used if desired.

In the embodiment illustrated in FIGS. 4A and 4B, ink inlet port 58 is formed as a single oblong opening arranged perpendicular to length dimension L of oblong recessed region 48. However, as illustrated in FIG. 5, as an alternative ink inlet port 58 may be formed as at least two separate openings 58-1, 58-2, that are spaced apart in width dimension W.

Figure 6:
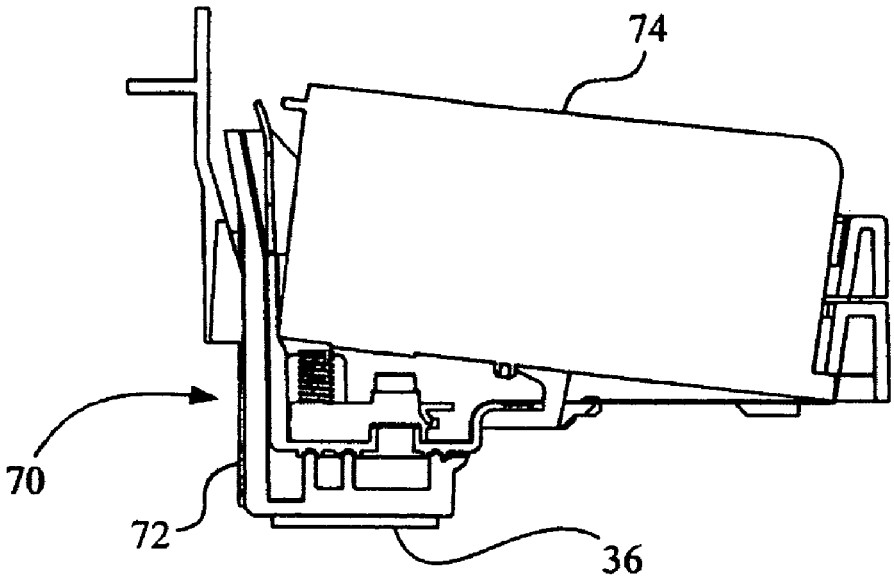
FIG. 6 is a side view of an ink jet printhead assembly having the ink jet printhead configured in accordance with an embodiment of the present invention, and showing a removable ink tank in an uninstalled position.

FIG. 6 shows another embodiment of the present invention in the form of an ink jet printhead assembly 70. Ink jet printhead assembly 70 includes a body 72 for detachably attaching an ink tank 74 that contains a supply of ink. In this embodiment, ink jet printhead 36 is attached to and is in fluid communication with body 72. Attachment of ink jet printhead 36 to body 72 may be performed, for example, using an adhesive. The configuration of ink jet printhead 36 in the present embodiment is the same as that described above with respect to FIGS. 4A and 4B, and thus for brevity will not be repeated here.

While this invention has been described with respect to exemplary embodiments of the invention, the present invention may be further modified within the spirit and scope of this disclosure. For example, the invention may be easily adapted for use with a stationary printhead, e.g., a page-wide array. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printhead for use in ink jet printing, comprising:

a substrate having an oblong recessed region forming a ceiling and interior side walls of a bubble chamber, said oblong recessed region having a length dimension and a width dimension, said length dimension being greater than said width dimension, said oblong recessed region having a first end spaced apart from a second end in said length dimension, and said substrate having an ink inlet channel passing through said ceiling to form an ink inlet port near said first end of said oblong recessed region;

a nozzle plate attached to said substrate to form a floor of said bubble chamber, said nozzle plate having an ink jet nozzle passing through said nozzle plate, said ink jet nozzle being positioned in fluid communication with said bubble chamber at a location near said second end of said recessed region; and a resistive heater element suspended from said first end to said second end of said oblong recessed region of said bubble chamber, and suspended between said floor and said ceiling of said bubble chamber.

2. The ink jet printhead of claim 1, wherein each of said first end of said oblong recessed region and said second end of said oblong recessed region are formed as a smooth curve.

3. The ink jet printhead of claim 1, wherein said oblong recessed region is oval in shape.

4. The ink jet printhead of claim 1, wherein said ink inlet port is formed as a single oblong opening.

5. The ink jet printhead of claim 1, wherein said ink inlet port is formed as at least two separate openings spaced apart in said width dimension.

6. A printhead assembly, comprising:

a body; and an ink jet printhead attached to and in fluid communication with said body, said ink jet printhead including:

a substrate having an oblong recessed region forming a ceiling and interior side walls of a bubble chamber, said oblong recessed region having a length dimension and a width dimension, said length dimension being greater than said width dimension, said oblong recessed region having a first end spaced apart from a second end in said length dimension, and said substrate having an ink inlet channel passing through said ceiling to form an ink inlet port near said first end of said oblong recessed region;

a nozzle plate attached to said substrate to form a floor of said bubble chamber, said nozzle plate having an ink jet nozzle passing through said nozzle plate, said ink jet nozzle being positioned in fluid communication with said bubble chamber at a location near said second end of said recessed region; and a resistive heater element suspended from said first end to said second end of said oblong recessed region of said bubble chamber, and suspended between said floor and said ceiling of said bubble chamber.

7. The printhead assembly of claim 6, wherein each of said first end of said oblong recessed region and said second end of said oblong recessed region are formed as a smooth curve.

8. The printhead assembly of claim 6, wherein said oblong recessed region is oval in shape.

9. The printhead assembly of claim 6, wherein said ink inlet port is formed as a single oblong opening.

10. The printhead assembly of claim 6, wherein said ink inlet port is formed as at least two separate openings spaced apart in said width dimension.

11. An ink jet printhead for use in ink jet printing, comprising:

a substrate having an oblong recessed region forming a ceiling and interior side walls of a bubble chamber, said oblong recessed region having a length dimension and a width dimension, said length dimension being greater than said width dimension, said oblong recessed region having a first end spaced apart from a second end in said length dimension, and said substrate having an ink inlet channel passing through said ceiling to form an ink inlet port near said first end of said oblong recessed region, wherein each of said first end of said oblong recessed region and said second end of said oblong recessed region are formed as a smooth curve; and a nozzle plate attached to said substrate to form a floor of said bubble chamber, said nozzle plate having an ink jet nozzle passing through said nozzle plate, said ink jet nozzle being positioned in fluid communication with said bubble chamber at a location near said second end of said recessed region.

12. The ink jet printhead cartridge of claim 11, wherein said oblong recessed region is oval in shape.

13. The ink jet printhead cartridge of claim 11, wherein said ink inlet port is formed as a single oblong opening.

14. The ink jet printhead cartridge of claim 11, wherein said ink inlet port is formed as at least two separate openings spaced apart in said width dimension.

15. The ink jet printhead cartridge of claim 11, further comprising a resistive heater element suspended from said first end to said second end of said oblong recessed region of said bubble chamber, and suspended between said floor and said ceiling of said bubble chamber.

* * * * *